US006266899B1

(12) United States Patent
Borsoi et al.

(10) Patent No.: US 6,266,899 B1
(45) Date of Patent: Jul. 31, 2001

(54) SPORTS BOOT

(75) Inventors: Bruno Borsoi, Victorio Veneto; Giuseppe Demonte, Borgofranco d'Ivrea, both of (IT)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/353,342

(22) Filed: Jul. 15, 1999

(30) Foreign Application Priority Data

Jul. 16, 1998 (FR) ..... 98 09248

(51) Int. Cl.[7] ..... A43B 5/04; A43B 5/16; A43B 15/00; A63C 5/04; A63C 11/00

(52) U.S. Cl. ..... 36/117.1; 36/115; 36/114; 36/78; 36/132; 36/136; 280/608; 280/611; 280/618; 280/811

(58) Field of Search ..... 36/117.1, 117.2, 36/115, 117.4, 114, 78, 132, 136; 280/607, 608, 11.15, 11.31, 611, 617, 811, 618

(56) References Cited

U.S. PATENT DOCUMENTS

Re. 27,512 * 10/1972 Onitsuka .
5,379,530 * 1/1995 Bell et al. .
5,690,350 * 11/1997 Turner et al. .
5,802,741 * 9/1998 Turner et al. .
5,875,566 * 3/1999 Bourdeau et al. .
5,887,877 * 3/1999 Nero .
5,906,058 * 5/1999 Rench et al. .
5,915,720 * 6/1999 Turner et al. .
6,000,704 * 12/1999 Balbinot et al. .

FOREIGN PATENT DOCUMENTS 0719505 7/1996 (EP) .
2754683 4/1998 (FR) .
WO96/03186 2/1996 (WO) .

* cited by examiner

*Primary Examiner*—Paul T. Sewell
*Assistant Examiner*—Anthony Stashick
(74) *Attorney, Agent, or Firm*—Greenblum & Bernstein P.L.C.

(57) ABSTRACT

A sports boot that includes an upper, an outer sole and at least one fastening member adapted to cooperate with an associated fastening member of a sports article, such as a snowboard, ski, or skate. The upper is provided at its lower end with a continuous peripheral belt, at least semi-rigid, and each fastening member of the boot is fixed on the peripheral belt. The peripheral belt can be arranged on the inside or on the outside of the upper.

45 Claims, 4 Drawing Sheets

2
2a
1
II
II
4
5
6
3

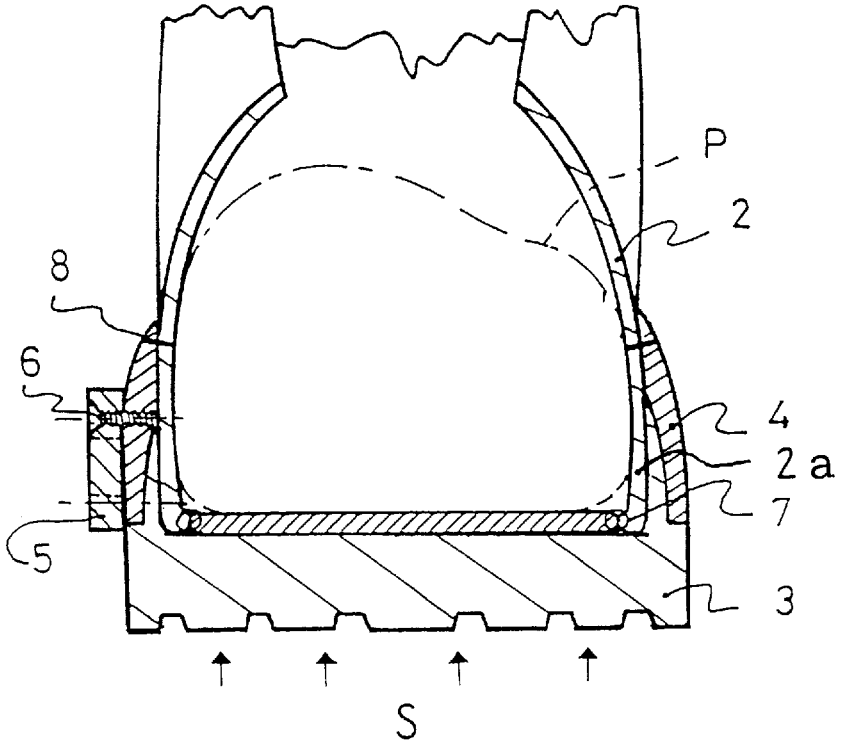
Fig: 2
Fig: 3
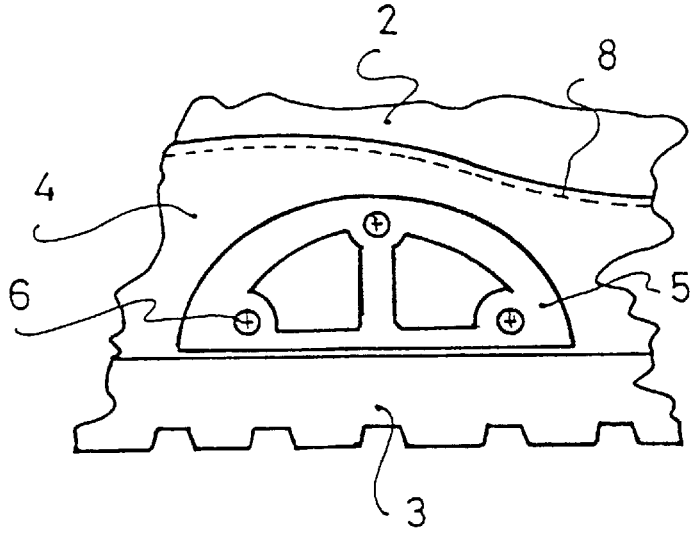

SPORTS BOOT

BACKGROUND OF THE INVENTION

1. Field of the Invention

The present invention relates to a sports boot, especially for gliding sports, such as snowboarding, but also skiing and skating, and having at least a member for fastening to an associated gliding apparatus, such as the snowboard, ski, skate, etc.

2. Description of Background and Relevant Information

"Step-in" type binding systems, are being developed more and more, especially in the field of snowboarding, in order to ensure the linkage of the boot to the snowboard. In this type of binding, the boot has a fastening member adapted to cooperate with a complementary fastening member fixed on the snowboard. Such systems are described, for example, in WO 96/03186.

Whereas in the traditional so-called shell snowboard binding systems the boot is a relatively flexible boot and is fixed to the board via plastic shells integral with the board and encompasses the boot by tightening bands called straps, step-in-type binding systems impose a rigid boot sole structure to allow a sufficient and firm anchoring of the anchoring member(s) of the boot adapted to cooperate with the associated anchoring members of the snowboard.

Indeed, contrary to the so-called shell systems where the linkage forces of the boot to the board are spread out uniformly via the plastic straps, in the system-type bindings, the forces are centered in the area of the fastening member(s) of the boot, and the anchoring of these members must be particularly firm in view of the fact that the forces to be transmitted are substantial.

The result is that for snowboard boots adapted to cooperate with system-type bindings, the boot sole should have a particularly rigid part, at least in the anchoring zone of the fastening member(s).

Thus, in EP 774 217, a metal insert is provided in the entire central zone of the boot sole to reinforce the anchoring zone.

In WO-A-96/03186 and in EP 719 505, a metal insert is provided in the longitudinal direction over the entire lower surface of the sole.

Such metal inserts in the sole present numerous drawbacks: excessive stiffening of the sole that is detrimental to walking, snow or ice interference with the metal insert housed under the sole, interruption of the transmission of sensations due to the presence of metal or rigid sole parts. However, this transmission of sensations is particularly important, especially when the gliding sport occurs on uneven ground, as with skiing or snowboarding, since it allows the athlete to react and to achieve appropriate movements.

SUMMARY OF THE INVENTION

An object of the present invention is therefore to overcome the aforementioned drawbacks and, in particular, to propose a new boot construction that reconciles the advantages of a traditional shell-type binding, namely the transmission of sensations especially, to those of a system- or step-in-type binding, especially the rapid binding of the boot to the board.

Another object of the present invention is also to propose a boot construction that is compatible with walking.

Finally, the invention must also be applicable to all sports boots which have the same problems for being fastened to a sport apparatus, as well as the problems of transmission of sensations, and problems related to the ease of walking, and especially to boots, such as ski boots, skating boots, etc.

This object is obtained in the sports boot according to the invention having an upper, an outer sole and at least one fastening member adapted to cooperate with an associated fastening member of a sports article, in that the upper is provided at its lower part with a continuous peripheral belt, at least semi-rigid, and in that each fastening member of the boot is fixed on the peripheral belt.

Indeed, the outer belt, which is at least semi-rigid, allows the anchoring of the fastening member(s), independently of the walking sole, and it is therefore compatible with a walking sole made of a flexible material that transmits sensations and actually allows walking.

The peripheral belt can be arranged inside or outside of the upper.

BRIEF DESCRIPTION OF DRAWINGS

The invention will be better understood and other characteristics thereof will be brought out with the following description, in reference to the attached schematic drawings that represent, by way of non-limiting example, several preferred embodiments in which:

FIG. 2 is a cross-section taken along line II—II of FIG. 1;

FIG. 3 is a side view of FIG. 1;

DETAILED DESCRIPTION OF THE INVENTION

Figure 1:
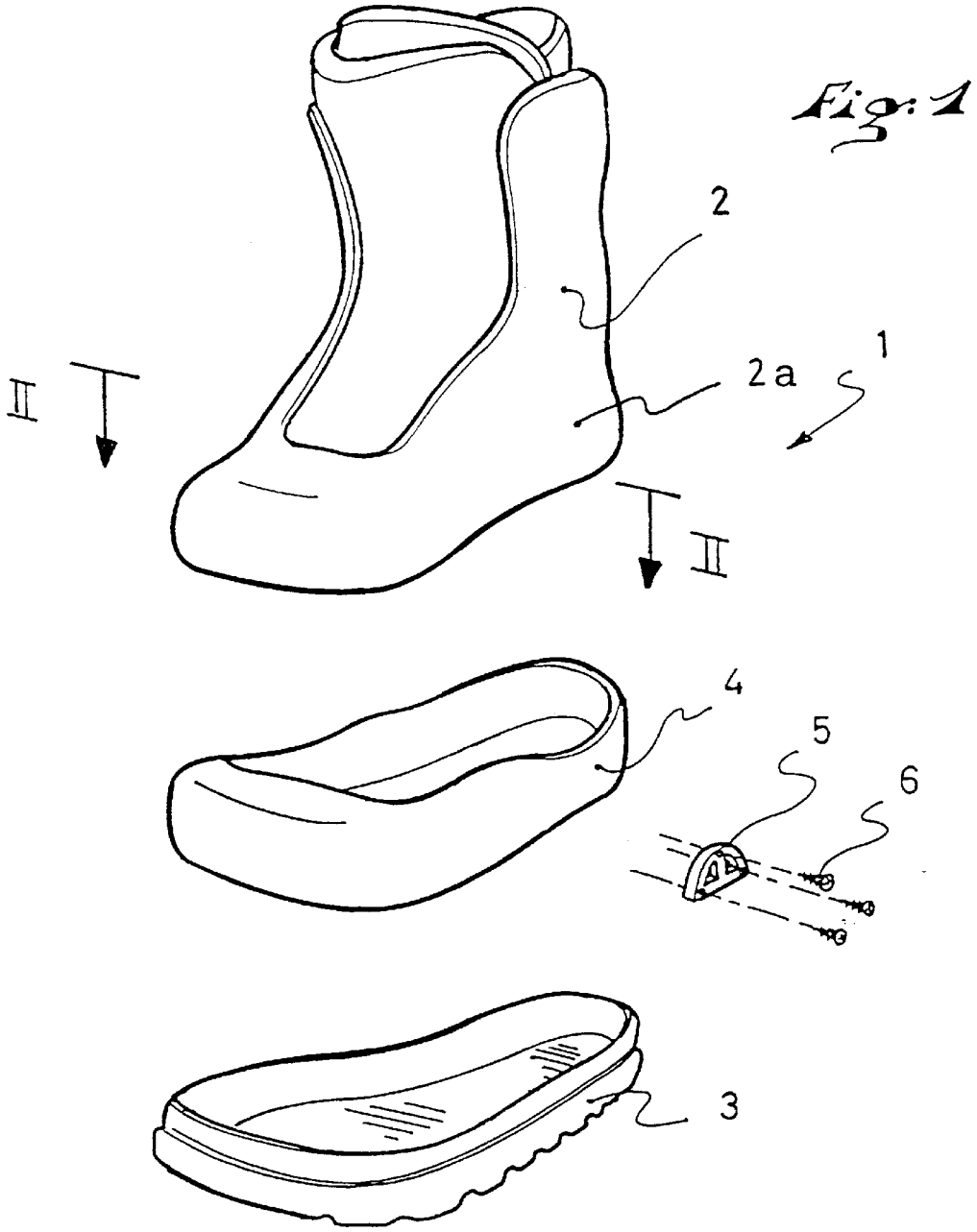
FIG. 1 is an exploded perspective view of a boot according to the invention.

As shown particularly in FIG. 1, the sports boot 1 according to the invention includes an upper 2, an outer sole 3, and a continuous peripheral belt 4 arranged in the area of the lower end 2*a* of the upper 2.

A fastening member 5, known per se, is laterally fixed to the peripheral belt 4, substantially in the central zone of the boot, preferably by means of screws or rivets 6.

Figure 4:
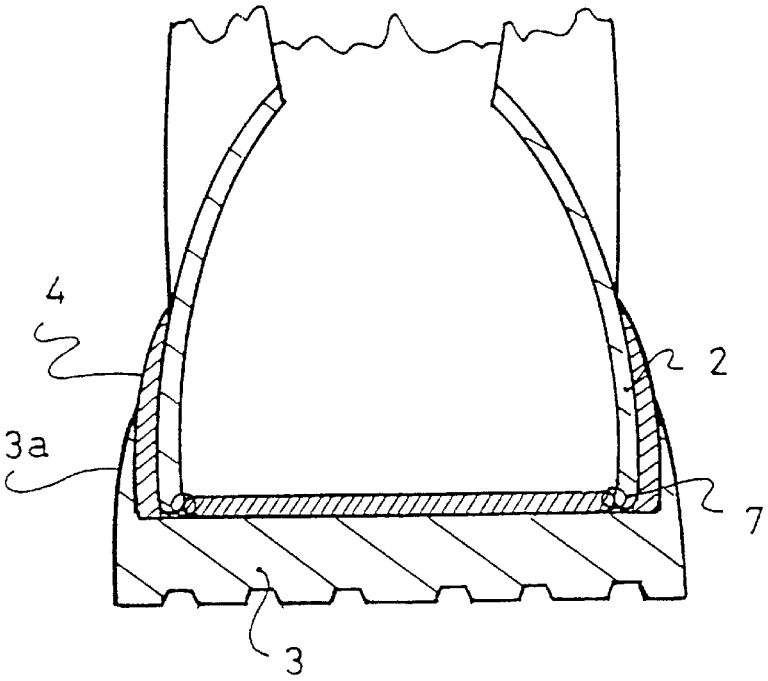
FIG. 4 is a view similar to FIG. 2 according to another embodiment.
Figure 6:
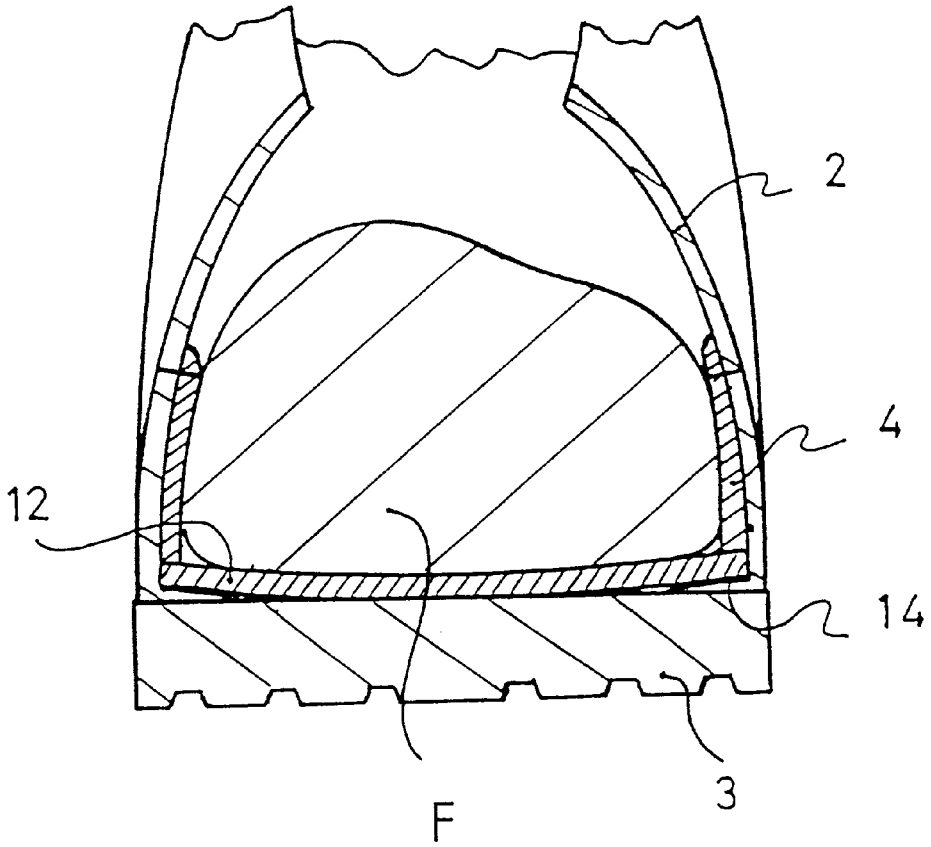
FIG. 6 is a view similar to FIG. 2 according to another embodiment.

The upper 2 is made according to any method known in itself and can especially be obtained by a strobel mounting, i.e., in the form of a liner closed by a low peripheral stitching 7, as shown in FIGS. 2 and 4, or by a traditional mounting on the form with an insole, as shown in FIG. 6. Of course, other methods for mounting the upper are also possible. The upper can also have a separate internal liner (not shown in the drawing).

The outer sole 3 can be constituted of a single or multiple material, for example, of EVA rubber, PU rubber, and it can have shock absorption properties and provide a grip while walking. Preferably, it is also made of a relatively flexible, and non-rigid, material.

The peripheral belt 4 is formed as a continuous element, made separately and then assembled by gluing to the lower end 2*a* of the upper. A method for assembly by gluing, such as disclosed in FR 96 12869, can be used to fix the peripheral belt 4. The assembly of the belt 4 is achieved preferably after gluing the outer sole 3. The peripheral belt 4 can also be injected directly onto the upper.

This belt 4 is at least semi-rigid, i.e., of a sufficient rigidity to allow a satisfactory anchoring of the fastening member 5.

By way of a non-limiting example, it can be made of a polyurethane (PU) having a hardness of about 60 Shore D. Depending upon the desired applications and the forces to be transmitted during the practice of the sport for which the boot is adapted, it can be more or less rigid.

The rigidity of the belt 4 in the peripheral direction can also be modified by appropriate thickness variations, especially for obtaining a greater flexibility at the front so as not to disturb the movement of the foot during walking, and a greater rigidity at the rear.

Preferably, and as shown particularly in FIGS. 2 and 3, the assembly of the peripheral belt 4 in the area of the fastening member 5 can be reinforced by appropriate stitchings 8 or any other reinforcement means, such as rivets.

Since the belt 4 is solely peripheral and does not have any portion extending in the horizontal direction with respect to the boot, all of the forces or sensations S originating from the ground or the gliding member are transmitted directly and integrally to the user's foot P via the sole 3, and with no filtering effect linked to the presence of a rigid part inserted between the sole 3 and the upper.

Such a boot therefore reconciles an efficient anchoring of the fastening member, with good transmission of the sensations and compatibility with walking.

Such a construction is compatible with the provision of one or several fastening members 5. These can also be arranged at any other area of the boot, and especially at the ends thereof.

FIG. 4 shows a second embodiment in which the outer sole 3 rises along a vertical peripheral edge 3*a* on the outer side of the upper 2 and the rigid belt 4.

This embodiment has the advantage of guaranteeing a certain impermeability of the upper 2/sole 3 linkage. In this case, the outer sole 3 is assembled to the upper after the belt 4 has been positioned.

Figure 5:
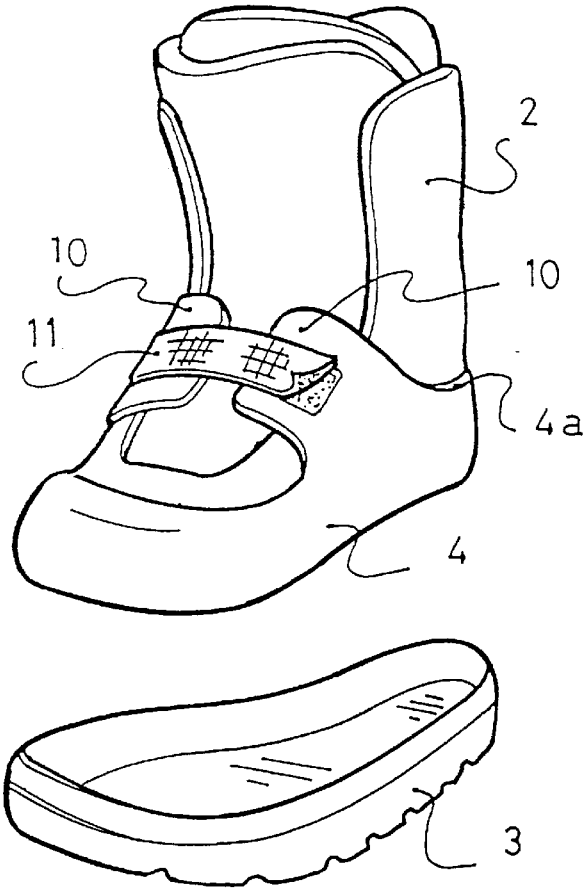
FIG. 5 is a view similar to FIG. 1 according to another embodiment.

In the embodiment of FIG. 5, two lateral tightening flaps 10, associated to tightening means 11 of the lacing or Velcro™ type, etc., are provided starting at the peripheral belt 4.

Each tightening flap 10 extends in the vertical direction from the upper edge 4*a* of the belt 4 up to the area of the top of the upper. These tightening flaps 10 are provided in the instep girth zone. They allow an improved tightening of the foot.

A single flap 10 can also be provided for an asymmetrical tightening of the foot.

Finally, FIG. 6 shows a last embodiment in which the peripheral belt 4 is arranged inside the upper 2. This arrangement has the advantage that the belt 4 is hidden.

In this embodiment, the upper 2 is mounted on the form F, according to the traditional process, by means of an insole 12 on which the lower end of the upper 2 is fixed by glue 14 and nails/staples, etc. Of course, this could also be a strobel mounting.

The present invention is not limited only to the previously described non-limiting/non-restrictive embodiment examples, by way of non-limiting example, but it encompasses all similar or equivalent embodiments. As indicated previously, it also applies to any sports boot for which similar problems should be resolved.

The instant application is based upon French application No. 98 09248, filed Jul. 16, 1998, the disclosure of which is hereby incorporated by reference thereto in its entirety, and the priority of which is hereby claimed under 35 USC 119.

What is claimed is:

1. A sports boot comprising an upper, an outer sole and at least one fastening member adapted to cooperate with an associated fastening member of a sports article, wherein the upper is provided at its lower part with a continuous peripheral belt, at least semi-rigid, and each fastening member of the boot is fixed on said peripheral belt.

2. A sports boot according to claim 1, wherein the peripheral belt is arranged inside the upper.

3. A sports boot according to claim 1, wherein the peripheral belt is arranged on the outside of the upper.

4. A sports boot according to claim 1, wherein the peripheral belt is fixed by gluing to the upper.

5. A sports boot according to claim 4, wherein the peripheral belt is assembled by stitching or by riveting to the upper, at least in an anchoring zone of each fastening member.

6. A sports boot according to claim 1, wherein the upper is a strobel-mounted upper.

7. A sports boot according to claim 1, wherein the upper is a form-mounted upper.

8. A sports boot according to claim 1, wherein the outer sole is assembled to the upper and the peripheral belt is assembled to the upper over a portion of the outer sole.

9. A sports boot according to claim 1, wherein the peripheral belt is assembled to the upper and the outer sole is assembled to the upper over a portion of the peripheral belt.

10. A sports boot according to claim 1, further comprising at least one lateral tightening flap extending upwardly from said belt substantially up to a level of an instep girth of the upper.

11. A sports boot according to claim 1, wherein the sports article is a gliding apparatus and is of a type wherein the sports boot is attached thereto by the fastening members.

12. A sports boot according to claim 11, wherein the gliding apparatus is one of a snowboard, ski, and skate.

13. A sports boot according to claim 1, wherein the sports article is a snowboard and the at least one fastening member of the boot is a component of a binding system for the snowboard, a second component of the binding system to be affixed to the snowboard.

14. A sports boot comprising:

an upper;

an outer sole fixed with respect to said upper;

a peripheral belt extending around a lower periphery of said upper, said peripheral belt being fixed with respect to said sole and with respect to said upper; and at least one binding member rigidly fixed to said peripheral belt, at least a portion of said binding member being exposed to enable cooperation with an associated binding member of a gliding apparatus.

15. A sports boot according to claim 14, wherein:

said peripheral belt comprises a rigid or semi-rigid material.

16. A sports boot according to claim 15, wherein:

said material of said peripheral belt is a polyurethane.

17. A sports boot according to claim 16, wherein:

said material of said peripheral belt has a hardness of about 60 Shore D.

18. A sports boot according to claim 14, wherein:

said peripheral belt is arranged inside said upper.

19. A sports boot according to claim 14, wherein:

said peripheral belt is arranged on the outside of said upper.

20. A sports boot according to claim 14, wherein:

said peripheral belt is fixed by gluing to said upper.

21. A sports boot according to claim 20, wherein:

said peripheral belt is fixed by stitching or by riveting to said upper, at least in an anchoring zone of each said binding member.

22. A sports boot according to claim 14, wherein:

said upper is a strobel-mounted upper.

23. A sports boot according to claim 14, wherein:

said upper is a form-mounted upper.

24. A sports boot according to claim 14, wherein:

said outer sole is fixed to said upper and said peripheral belt is fixed to said upper over a portion of said outer sole.

25. A sports boot according to claim 14, wherein:

said peripheral belt is fixed to said upper and said outer sole is fixed to said upper over a portion of said peripheral belt.

26. A sports boot according to claim 14, further comprising:

at least one lateral tightening flap extending upwardly from said belt substantially up to a level of an instep girth of said upper.

27. A sports boot according to claim 14, wherein:

said outer sole is a walking sole comprising a flexible non-rigid material.

28. A sports boot according to claim 14, wherein:

said at least one binding member is rigidly affixed to said peripheral belt by means of screws or rivets.

29. A snowboard boot comprising:

an upper;

an outer sole fixed with respect to said upper;

a peripheral belt extending around a lower periphery of said upper, said peripheral belt being fixed with respect to said sole and with respect to said upper; and at least one binding member rigidly fixed to said peripheral belt, at least a portion of said binding member being exposed to enable cooperation with an associated binding member of a snowboard.

30. A snowboard boot according to claim 29, wherein:

said peripheral belt comprises a rigid or semi-rigid material.

31. A snowboard boot according to claim 30, wherein:

said material of said peripheral belt is a polyurethane.

32. A snowboard boot according to claim 31, wherein:

said material of said peripheral belt has a hardness of about 60 Shore D.

33. A snowboard boot according to claim 29, wherein:

said binding member is affixed to said peripheral belt at a side of said upper, between a front end and a rear end of said upper.

34. A snowboard boot according to claim 29, wherein:

said peripheral belt is arranged inside said upper.

35. A snowboard boot according to claim 29, wherein:

said peripheral belt is arranged on the outside of said upper.

36. A snowboard boot according to claim 29, wherein:

said peripheral belt is fixed by gluing to said upper.

37. A snowboard boot according to claim 29, wherein:

said peripheral belt is fixed with rivets to said upper, at least in an anchoring zone of each said binding member.

38. A snowboard boot according to claim 29, wherein:

said peripheral belt is fixed by stitching to said upper, at least in an anchoring zone of each said binding member.

39. A snowboard boot according to claim 29, wherein:

said upper is a strobel-mounted upper.

40. A snowboard boot according to claim 29, wherein:

said upper is a form-mounted upper.

41. A snowboard boot according to claim 29, wherein:

said outer sole is fixed to said upper and said peripheral belt is fixed to said upper over a portion of said outer sole.

42. A snowboard boot according to claim 29, wherein:

said peripheral belt is fixed to said upper and said outer sole is fixed to said upper over a portion of said peripheral belt.

43. A snowboard boot according to claim 29, further comprising:

at least one lateral tightening flap extending upwardly from said belt substantially up to a level of an instep girth of said upper.

44. A snowboard boot according to claim 29, wherein:

said outer sole is a walking sole comprising a flexible non-rigid material.

45. A snowboard boot according to claim 29, wherein:

said at least one binding member is rigidly affixed to said peripheral belt by means of screws or rivets.

* * * * *